US006491285B1

(12) United States Patent
Tomita

(10) Patent No.: US 6,491,285 B1
(45) Date of Patent: Dec. 10, 2002

(54) WINCH HANDLE RETENTION SYSTEM

(76) Inventor: Paul K. Tomita, 2404 Spaulding Ave., Berkeley, CA (US) 94703

( * ) Notice: Subject to any disclaimer, the term of this patent is extended or adjusted under 35 U.S.C. 154(b) by 0 days.

(21) Appl. No.: 09/684,637

(22) Filed: Oct. 10, 2000

(51) Int. Cl.[7] ..... B66D 1/00
(52) U.S. Cl. ..... 254/266; 16/422
(58) Field of Search ..... 254/266; 403/11, 403/12, 359.6; 16/422

(56) References Cited

U.S. PATENT DOCUMENTS 3,167,338 A * 1/1965 Troike ..... 279/77
3,608,936 A * 9/1971 Karden ..... 403/316
3,733,937 A * 5/1973 Mezey ..... 81/125.1
3,865,500 A * 2/1975 Newell ..... 16/422
4,606,671 A * 8/1986 Rasmussen ..... 403/14
4,883,255 A * 11/1989 Bacon ..... 16/332
5,257,557 A * 11/1993 Batten ..... 279/93
5,702,088 A * 12/1997 Roberge ..... 114/144 R
5,833,217 A * 11/1998 Goldsby ..... 254/266

* cited by examiner

*Primary Examiner*—Emmanuel Marcelo
(74) *Attorney, Agent, or Firm*—Paul K. Tomita

(57) ABSTRACT

A sailboat winch handle system has a locking plate that is mounted in a fixed configuration to the bottom of the winch handle plug and prevents the accidental removal of the winch handle from the socket of a winch. Normally, only downward and rotational forces are applied to the winch handle. The locking plate engages an interior surface of the winch socket when an upward force is excerpted upon the winch handle preventing the winch handle form accidentally being dislodged from the winch socket.

17 Claims, 5 Drawing Sheets

WINCH HANDLE RETENTION SYSTEM

FIELD OF THE INVENTION

This invention relates to winch handles or hand cranks which are used to rotate a winch.

BACKGROUND OF THE INVENTION

Sailboats utilize sails to drive propel boats through the water. Ropes or lines are used to control the shape and position of the sails. The sails are typically triangular and configured with an upper comer (head), forward comer (tack) and rear corner (clue). The shape and position of the sails are controlled by lines which are made of rope and/or wire. The lines connected to the head of the sails are called halyards. The lines connected to the clues of the sails are called sheets and the lines connected the tack of the spinnaker are called guys. The position of these exemplary lines and many other lines are controlled by winches.

Referring to FIG. 1, a line 103 is held in place by wrapped it around the winch drum 105 several times. Tension on the first end 111 and the second end 113 creates friction between the winch drum 105 and the line 103. The surface of the winch drum 105 may be textured to increase friction. When there is sufficient friction the line 103 moves as the winch drum 105 rotates. The winch 107 has an internal gear system that rotates the winch drum 105 when a center socket (not shown) at the top center is rotated.

A winch handle 121 has a socket (not shown), an arm 123 and a handle 125. The socket of the winch handle 121 is releasably insertable into the center plug. By manually rotating the handle 125 around the winch 107, the center socket is rotated driving the internal gearing and causing the winch drum 105 to rotate and the line 103 to move. The winch drum 105 is ratcheted so that it only rotates in one direction, typically clock-wise when viewed from above. A substantial amount of tension can be produced in the line 103 due the gearing of the winch 107.

It is often necessary to quickly remove the line 103 from the winch 107. In order to improve the speed which the line can be removed from the winch 107, the winch handle 121 is first removed from winch 107 while tension is maintained on the line 103. With the winch handle 121 removed the line 103 can be released from the winch 107 by pulling the line 103 straight up and off the winch drum 105 without fouling on the winch handle 121.

A problem with winch handles is that they may be accidentally dislodged from the winches and become lost in the surrounding water when they fall off the boat. In order to reduce this problem, the locking which handle was developed. Referring to FIG. 2, a locking winch handle 221 inserted into a winch 207 is illustrated the winch socket 251 and winch handle plug 261 are typically splined such that when engaged, there is no relative rotation between the winch socket 251 and the plug 261 when the winch handle 221 is rotated about the winch 207. The winch 207 has a splined socket 251 which is geared to rotate the winch drum 205 and an enlarged space below the splined socket 251. The locking plate 263 is connected to a shaft 265 and is rotationally actuated by a switch 267 relative to the plug 261 and below the splines of the socket 251 is an open space 255.

Referring to FIG. 3A, the bottom of the locking plate 363 is illustrated. In the normal position, the locking plate 263 is rotated relative to the splines of the plug 361 to be out of alignment with the splines of the socket 351 which locks the winch handle into the winch and prevents the accidental removal of the plug 261 from the socket 351. The winch handle may have an internal spring that normally positions the locking 363 out of alignment with the splines of the plug 361. Referring to FIG. 3B, when the switch is actuated, the locking plate 363 is rotated into alignment with the splines of the plug 361 allowing the plug 361 to be inserted or removed from the socket 351. When a locking plate 363 mounted on the bottom of the plug 361 is aligned with the splines of the plug 361 the winch handle may be inserted or removed from the winch.

A problem with the rotating plate locking mechanism is that it utilizes a mechanism that requires manual manipulation in order to insert and remove the winch handle and is prone to failure. Further the rotating plate may be exposed to a salt water environment that can cause rotating shaft to seize within the plug preventing the rotation of the locking plate. If the plate mechanism malfunctions or seizes, it may be impossible to insert into or remove the winch handle from the winch.

What is needed is a winch handle that has a retention mechanism that does not require manual manipulation of a switch and does not have internal rotating components that can seize in corrosive environments.

SUMMARY AND OBJECTIONS OF THE PRESENT INVENTION

The present invention is a system for retaining a winch handle within a socket using a locking plate mounted to the bottom of the splined plug. The locking plate may be rectangular in shape and may extend away from the bottom of the plug at one edge. Normally, when the plug of the winch handle in inserted into the socket of a winch, the plug and socket have substantially the same center axis and the locking plate rests below the lower edge of the socket splines. During normal use, there is no tendency for the winch handle plug to fall out of the socket because only downward and rotational forces are applied to the grip of the winch handle.

An accidental impact with the winch handle may produce an upward force upon the bottom of the winch handle arm causing the plug to rotate within the winch socket. This rotation of the socket causes the locking plate to engage the lower edge of the socket splines. The interference of the locking plate and lower edge of the socket splines prevents the winch handle plug from sliding out of the winch socket which retaining the winch handle in the winch.

In an embodiment, a lower portion of the winch plug facing the arm is cut away. The cut away section of the plug allows the plug to rotate farther within the socket when an upward force is applied to the winch arm. The cutaway section of the plug also exposes a larger section of the locking plate and allows a larger area of the locking plate to interfere with the lower edge of the socket splines.

In an embodiment, the bottom portion of the locking plate is tapered, conical or hemispherical in shape which allows the winch handle plug to be more easily aligned and inserted into the socket.

BRIEF DESCRIPTION OF THE DRAWINGS

The present invention is illustrated by way of example and not limitation in the figures of the accompanying drawings, in which like references indicate similar elements, and in which.

DETAILED DESCRIPTION

Figure 1:
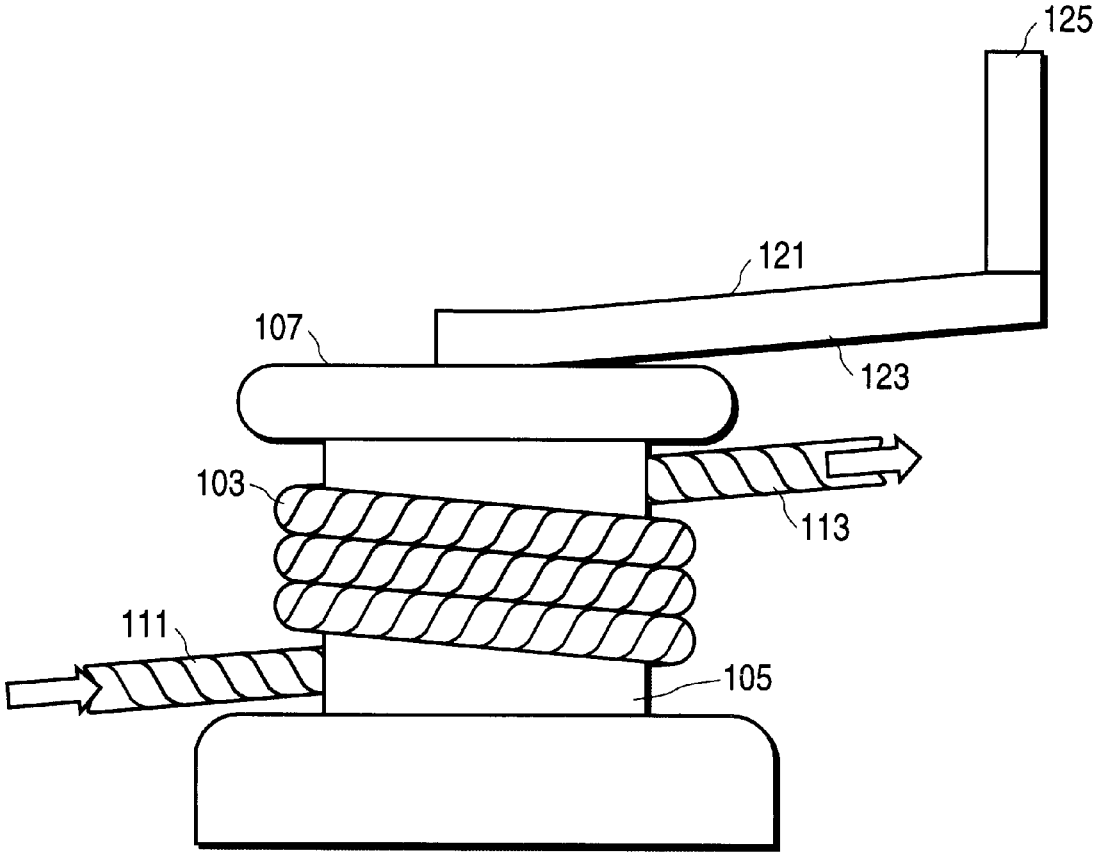
FIG.1 (PRIOR ART)
FIG. 1 illustrates a side view of a line coiled around a winch and a winch handle inserted into the winch.
Figure 2:
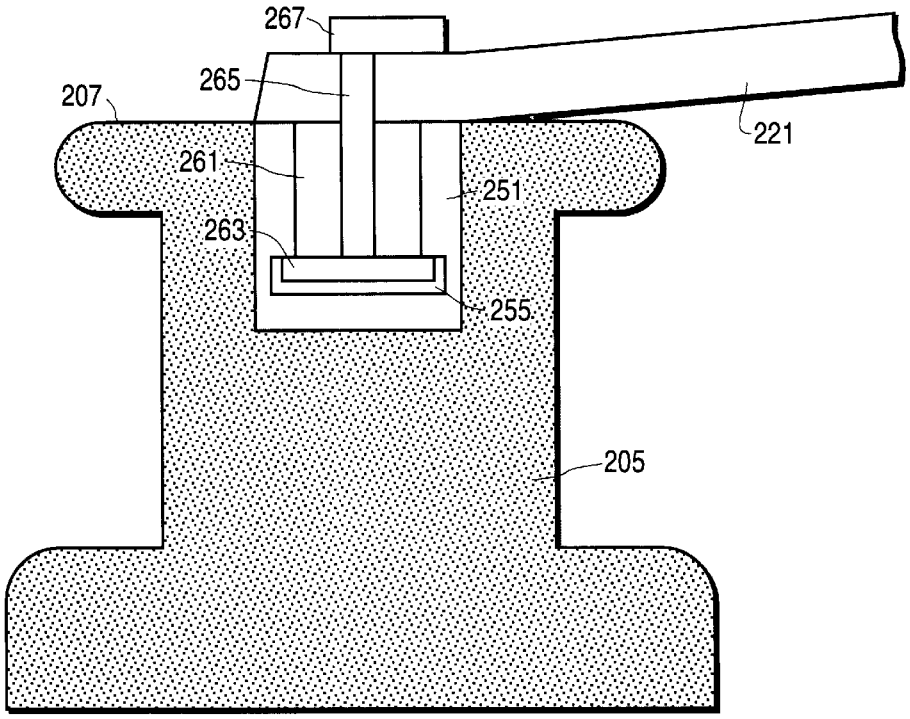
FIG.2 (PRIOR ART)
FIG. 2 illustrates a cut away view of a winch handle inserted into a winch.
Figure 3A:
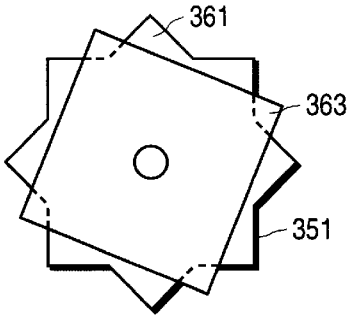
FIG.3A (PRIOR ART)
FIG. 3A illustrates a bottom view of a locking plate and plug inserted into a winch socket, wherein the locking plate is out alignment with the splines of the socket.
Figure 3B:
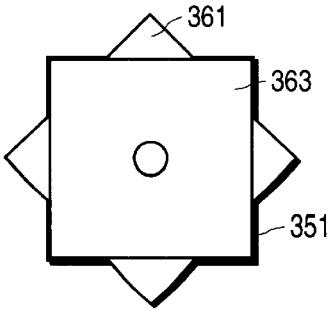
FIG.3B (PRIOR ART)
FIG. 3B illustrates a bottom view of a locking plate and plug inserted into a winch socket, wherein the locking plate is in alignment with the splines of the socket.

The following is a detailed description of the presently preferred embodiments of the present invention. However, the present invention is in no way intended to be limited to the embodiments discussed below or shown in the drawings. Rather, the description and the drawings are merely illustrative of the presently preferred embodiments of the invention.

The present invention overcomes the problems associated with a moving locking mechanism. The present invention utilizes a fixed plate that only engages the bottom edge of the socket splines to retain the winch handle plug in the splined socket of the winch when the winch handle is rotated vertically.

Figure 4:
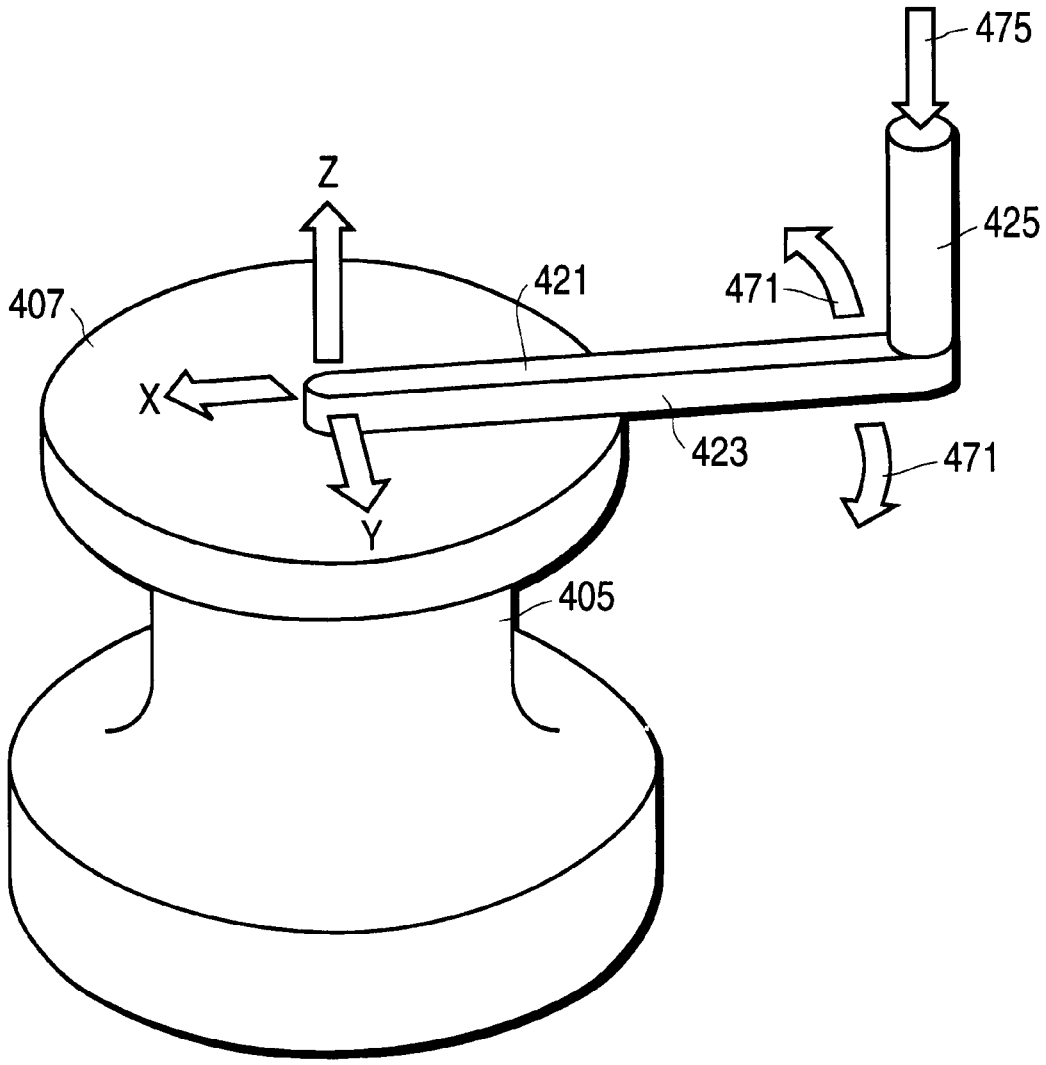
FIG. 4 illustrates a winch, winch handle and forces normally applied to the winch handle.

Referring to FIG. 4, an X-Y-Z axis is illustrated at the junction of the winch handle 421 and winch socket 451. During normal use two forces are applied to the winch handle. A rotational force 471 is applied to the winch handle grip 425 in the Y direction as the operator rotates winch handle about the winch 407. The rotational force causes a first torque to be applied to the plug about the Z axis. The torque is equal to rotational force x winch handle arm 423 length. Because the plug is configured to rotate about the Z axis, the rotational force 425 results in rotation of the drum 405. A downward force 475 is applied to the winch handle grip 425 by the operator as well as by gravity in the Z direction. A downward force 475 causes a second torque to the plug about the Y axis. The plug does not move in the Z direction, thus the winch handle 421 is maintained in the X-Y plane.

As discussed, the winch handle plug is removably inserted into the winch socket.

Figure 5A:
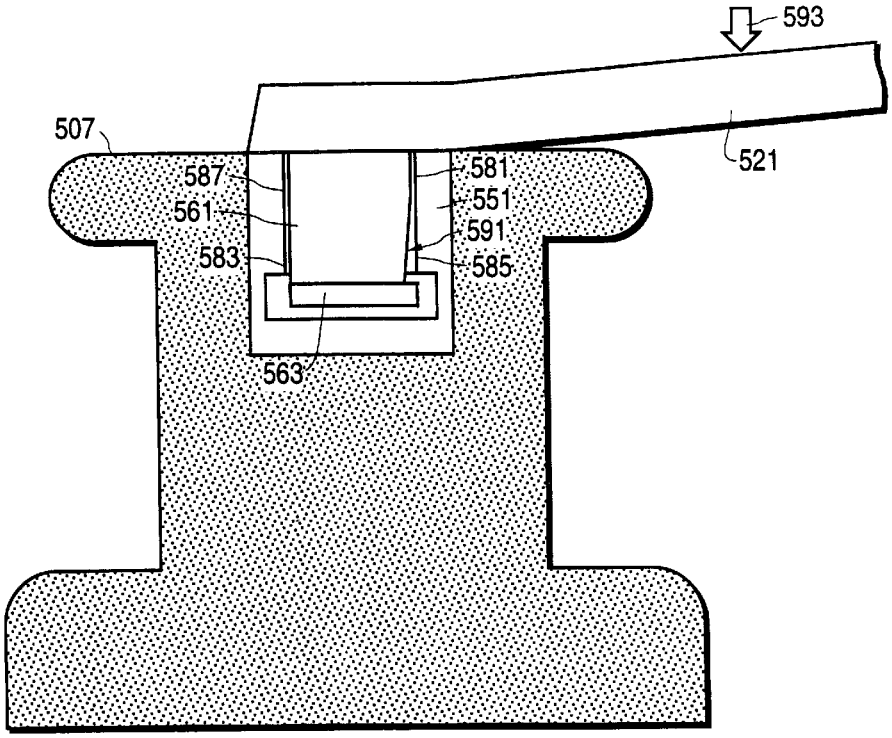
FIG. 5A illustrates a cross section of a winch and an embodiment of the inventive winch handle during normal use.

In order for the plug to fit easily into the socket, the outer surfaces of the plug are slightly smaller than the inner surfaces of the socket. Thus, there is a gap between the plug and socket. Referring to FIG. 5A, in the normal operation, the plug 561 and socket 551 contact each other at points 581 and 583 because a downward force 593 is applied to the winch handle 521 by the operator. The plug and socket are not in contact at points 587 and 585. Because the plug does not contact the socket at point 585, this section of the plug is non-functional during normal use and the socket 561 can include a cut away section 591 without interfering with the normal operation of the winch handle 521.

Winch handles may be accidentally dislodged from the winch when the winch handle is knocked upwards. In order to knock the winch handle upwards, contact must be made to the lower surface of the winch handle. This upward impact may result from a person, a tensioned line or any other physical object. This contact most commonly occurs below the winch handle grip section because this is the portion of the winch handle that protrudes over the outer edge of the winch. An upward force below the grip section of the winch handle results in a rotation of the winch handle about the Y axis which is opposite in direction to the normal downward force.

Figure 5B:
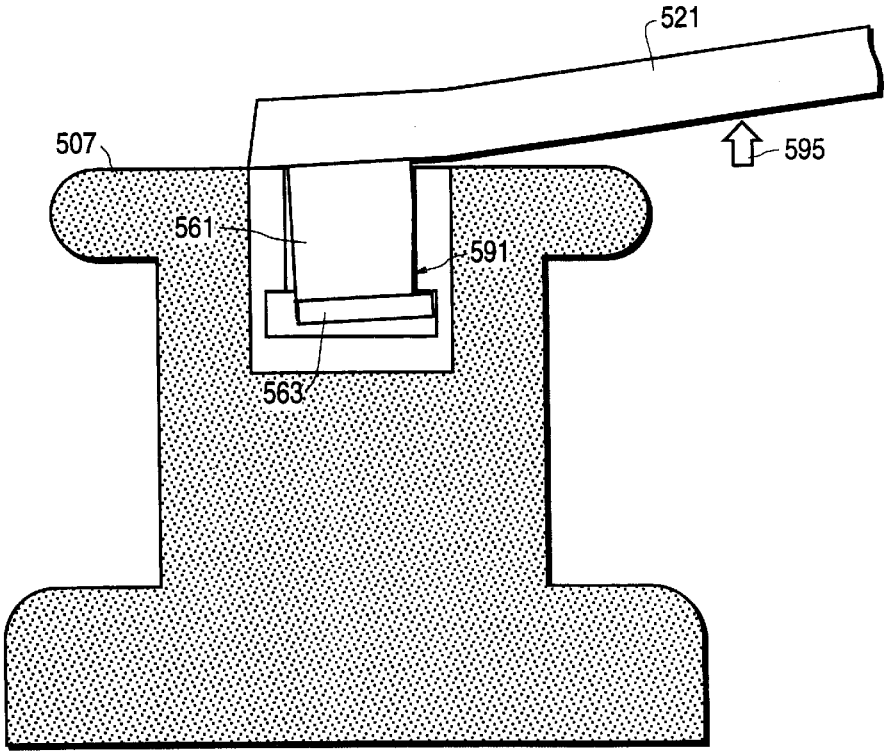
FIG. 5B illustrates a cross section of a winch and an embodiment of the inventive winch handle in the locked position.

Referring to FIG. 5B, the inventive winch handle socket 561 has a cut away section 591 and a fixed lower plate 563. When however an upward force 595 is applied to the grip portion of the winch handle, the cut away section 591 allows the winch handle plug 561 to rotate about the Y axis farther than a plug not having the cut away section 591. When the plug is fully rotated the lower plate 563 engages the lower edge of the splines of the socket 551. The engagement of the lower plate 563 and the lower edge of the socket 551 splines prevents the winch handle 521 from being removed from winch 507.

Figure 6A:
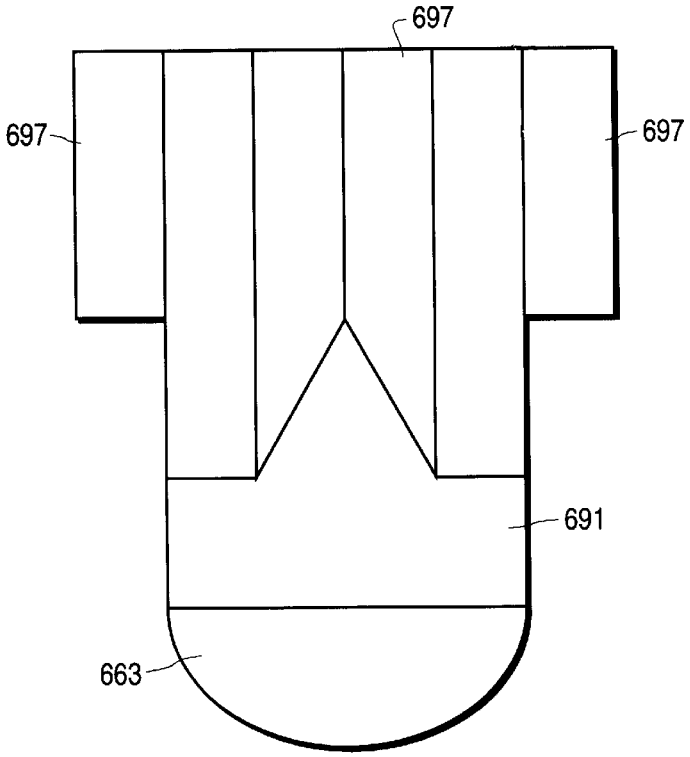
FIG. 6A illustrates front view of an embodiment of the inventive winch handle plug.
Figure 6B:
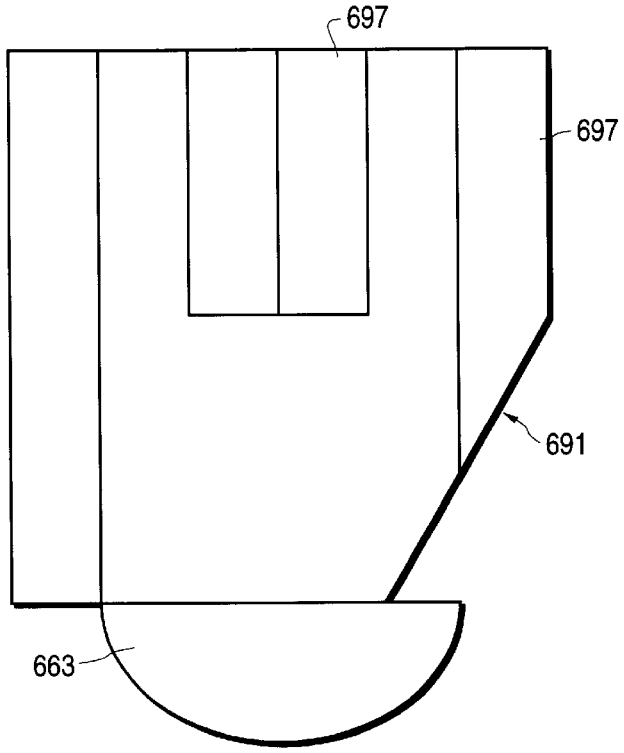
FIG. 6B illustrates side view of an embodiment of the inventive winch handle plug.

In an embodiment, portions of the plug splines are removed in order for the plug to rotate within the socket allowing the lower plate to engage the lower edge of the socket splines. Referring to FIGS. 6A and 6B, an embodiment of the plug having a cut away section 691 and some partially removed splines 697 is illustrated. The cut away section 691 and removal of portions of the splines 697 allows the plug 661 to rotate within the socket, which allows center axis of the plug 661 to rotate into misalignment with the center axis of the socket. If there is a sufficient gap between the plug 661 and socket, a portion of the plug may not need to be removed (the cut away section 691) and the plug splines 697 may not need to be partially removed.

In order for an operator to remove the inventive winch handle from a winch, the winch handle may be grasping at the plug section and pulled up to remove the plug from the socket. By pulling up at the plug section, the weight of the arm and grip will rotate the socket so that the lower plate does not engage the lower edge of the splines. The operator may also remove the winch handle by grasping the arm section and exerting a rotational force that prevents the lower plate from engaging the lower edge of the splines while pulling up on the winch handle.

As discussed, the winch handle plug must be positioned directly above the winch socket and the splines of the plug must be aligned with the splines of the socket to insert the plug into the socket. The lower plate may be a planar piece or a three dimensional component having a tapered, conical, curved or hemispherical shape. In an embodiment, the lower plate is planar and the inventive winch handle is inserted into the winch socket like a normal non-locking winch handle. In an alternative embodiment, the inventive lower plate is tapered, conical, curved or hemispherical in shape. By using a tapered, conical or hemispherical lower plate the plug is more easily aligned with the socket because the smaller cross sectional area of the bottom of the lower plate will more easily engage the socket opening. The smaller cross section bottom engages the socket and the tapered or curved sides of the lower plate assist in aligning the plug with the socket. This is similar to the difference between placing a cylinder and a sphere into a hole. It is easier to insert a sphere in a close fitting circular hole that a cylinder. The added material of the tapered, conical or hemispherical lower plate will also be structurally stronger than a planar lower plate.

Referring to FIGS. 6A and 6B, the locking plate 663 has an exposed surface that is spherical.

There are several suitable materials for the inventive winch handle. In the preferred embodiment, the winch handle plug is made of a durable metal such as aluminum, stainless steel, bronze, titanium and any other suitable metal. In the preferred embodiment, the winch handle plug and lower plate are made of the single piece of metal. It is also possible for the lower plate to be a separate piece and a different material that is attached to the plug. The lower plate may be attached to the plug by a fastener, adhesive, welding, bolt(s) or any other suitable attachment mechanism. Because the lower plate is subjected to a substantial amount of abrasion due to impact with the winch socket, the lower plate material may be coated with a protective layer. The locking plate maybe plated or include a plastic layer which reduces the insertion friction. The locking plate may also be replaceable if the locking plate is broken or heavily worn.

The arm of the winch handle may be made out of the same piece of material as the plug or it may be a separate piece made of the same material as the plug or a different material. The arm may also be a composite of materials such as plastic, carbon fiber, fiberglass, and metals. The arm may also be a hollow structure or a construction that allows the winch handle to float in water. Specifically, if the weight of the winch handle divided by the volume of the winch handle is less than the density of water or salt water, the winch handle will float. The arm may be attached to the plug by fasteners, an adhesive, welding, bolt(s) or any other suitable attachment means.

The winch handle grip may rotate about a spindle that is attached to the winch handle arm. Bearings and/or bushings may be used within the grip to minimize the rotational friction of the grip during normal use. The bearings and bushings may be steel, plastic or any other suitable material. The grip is preferably plastic, metal or a combination of materials. The grip may be configured to be grasped by a single hand or two hands. Preferably, all of the materials used in the inventive winch handle are resistant to corrosive salt water environments.

In the foregoing, a winch handle retention system has been described. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A winch handle apparatus comprising:

an arm;

a grip attached to the first end of the arm;

a plug attached to a second end of the arm having a substantially rectangular cross section and a cut away section along a portion of the plug; and a locking plate attached in a fixed relationship to the bottom of the plug;

wherein the locking plate can releasably engage an interior surface of the socket when the plug is rotated within the socket about an axis of rotation that is substantially perpendicular to the length of the plug.

2. The winch handle apparatus of claim 1, wherein a lower cross section of the plug is smaller than an upper cross section of the plug.

3. The winch handle apparatus of claim 1, wherein the plug has a cut away section that is adjacent to a portion of the locking plates.

4. The winch handle apparatus of claim 1, wherein the locking plate and plug are fabricated from a single piece of metal.

5. The winch handle apparatus of claim 1, wherein the locking plate and the plug are made of aluminum, stainless steel or titanium.

6. The winch handle apparatus of claim 1, wherein a portion of the locking plate has a rectangular cross section.

7. The winch handle apparatus of claim 1, wherein an exposed surface of the locking plate is substantially tapered, conical, curved or hemispherical in shape.

8. The winch handle apparatus of claim 1, wherein a portion of the locking plate has a rectangular cross section.

9. The winch handle apparatus of claim 1, wherein an exposed surface of the locking plate is substantially tapered, conical, curved or hemispherical in shape.

10. A winch handle apparatus comprising:

an arm;

a grip attached to a first end of the arm having a plurality of splines aligned along the length of the plug and a cut away section along a portion of the plug; and a locking plate attached to the bottom of the plug in a fixed relationship;

wherein the locking plate can releasably engage an interior surface of a socket when the plug is rotated within the socket about an axis of rotation that is substantially perpendicular to the length of the plug.

11. The winch handle apparatus of claim 10, wherein at least one of the plurality of splines is non-uniform along the length of the plug.

12. The winch handle apparatus of claim 10, wherein a lower cross section of the plug is smaller than an upper cross section of the plug.

13. The winch handle apparatus of claim 10, wherein the locking plate and plug are fabricated from a single piece of metal.

14. The winch handle apparatus of claim 13, wherein the locking plate and the plug are made of a single piece of aluminum, stainless steel or titanium.

15. A method of preventing the accidental removal of a winch handle from a winch, comprising the steps of:

providing a winch handle having an arm, a splined plug and a locking plate, wherein the arm is mounted on one end of the splined plug and the locking plate is mounted at a second end of the splined plug and the arm, splined plug and locking plate are in a stationary relationship to each other;

providing a winch having a splined socket and an interior edge;

aligning the splined plug with the splined socket;

inserting the splined plug into the splined socket;

applying an upward force upon the winch handle;

rotating the plug within the socket such that the locking plate engages the interior edge of the splined socket preventing the removal of the plug from the socket.

16. The method of preventing the accidental removal of a winch handle from a winch of claim 15 wherein the plug has a cutout section at a portion of the plug proximate the locking plate.

17. The method of preventing the accidental removal of the winch handle from the winch of claim 15, wherein an exposed surface of the locking plate is substantially tapered, conical, curved or hemispherical in shape.

* * * * *